US007377212B1

(12) United States Patent
Wang

(10) Patent No.: US 7,377,212 B1
(45) Date of Patent: May 27, 2008

(54) AUTOMATIC BAND CONVEYING DEVICE

(75) Inventor: Hermes Wang, Taiping (TW)

(73) Assignee: Jangzin Industrial Co., Ltd., Taichung County (TW)

( * ) Notice: Subject to any disclaimer, the term of this patent is extended or adjusted under 35 U.S.C. 154(b) by 0 days.

(21) Appl. No.: 11/943,483

(22) Filed: Nov. 20, 2007

(51) Int. Cl.
*B65B 13/04* (2006.01)

(52) U.S. Cl. ..... 100/26; 100/25; 242/615; 53/589

(58) Field of Classification Search ..... 100/8, 100/25, 26, 29, 32; 53/589; 242/615, 615.1
See application file for complete search history.

(56) References Cited

U.S. PATENT DOCUMENTS 5,249,518 A * 10/1993 Abrams ..... 100/26
6,655,117 B2 * 12/2003 Hoshino ..... 53/589
6,951,170 B2 * 10/2005 Lininger et al. ..... 100/26

* cited by examiner

*Primary Examiner*—Jimmy T Nguyen
(74) *Attorney, Agent, or Firm*—Ming Chow; Sinorica, LLC

(57) ABSTRACT

An automatic band conveying device includes a band transmitting device employed to pass a band into a band rail, and a pressing rail device composed of an electromagnetic valve, a connecting rod and a pressing plate. As the electromagnetic valve is electrified, it can generate magnetic force to enable a movable member pivotally formed on its top to be moved, so that the connecting rod can be driven by the movable member to push a pressing side of the pressing plate to press on the band rail. Thus the automatic band conveying device is simply structured and easy to operate.

6 Claims, 11 Drawing Sheets

AUTOMATIC BAND CONVEYING DEVICE

BACKGROUND OF THE INVENTION

1. Field of the Invention

This invention relates to a strapping machine, particularly to one installed with a simple automatic band conveying device able to easily and automatically transmitting a band by means of an electromagnetic valve to drive a connecting rod to push a pressing plate to press on a band rail.

2. Description of the Prior Art

As shown in FIGS. 1 and 2, a conventional automatic band conveying device includes a band conveying device 10 used to transmit a band 11 into a band rail 12, and a pressing rail device 20 which is composed of a gear motor 21, a brake 22, a band passage pressing rod 23 and a proximity switch 24. The gear motor 21 is fixed at one side of the band rail 12. The brake 22 and the band passage pressing rod 23 are orderly mounted on a rotating axis 211 of the gear motor 21. By means of the proximity switch 24, the rotating axis 211 of the gear motor 21 can drive the band passage pressing rod 23 to rotate for a preset angle. And, the gear motor 21 is then to be stopped by the brake 22 to keep the band passage pressing rod 23 pressing on a band passage 13 of the band rail 12 for the band 11 to pass through to a lower separate mechanism 14. Next, the brake 22 can automatically release the gear motor 21 to let it rotate in reverse and the band passage 13 is elastically pushed back to its original position by a compression spring 15. However, in operation, the position and the rotating direction of the gear motor 21 and the brake 22 must be detected and controlled by the proximity switch 24, creating a complicated operation to be apt to pose a shutdown or a breakdown of the conventional automatic band conveying device. Moreover, with too many proximity switches 24 used in the conventional automatic band conveying device, not only the operation is much lowered because of frequent malfunction of the proximity switch 24, but also the cost is high.

SUMMARY OF THE INVENTION

The objective of this invention is to offer an automatic band conveying device installed inside a main body of a strapping machine.

The main characteristics of the invention are a band transmitting device employed to pass a band into a band rail, and a pressing rail device. The pressing rail device is composed of an electromagnetic valve, a connecting rod and a pressing plate. When the electromagnetic valve is electrically conducted, it can generate a magnetic force to enable a movable member pivotally formed on its top to be moved, so that the connecting rod can be driven by the movable member to push a pressing side of the pressing plate to press on the band rail. So, the present invention can be easily operated by only turning the electromagnetic valve on/off without fear of unexpected erroneous operation, with its reliability enhanced. Also, cost can be lowered as the present invention has few components than the conventional one.

BRIEF DESCRIPTION OF DRAWINGS

This invention is better understood by referring to the accompanying drawings, wherein.

DETAILED DESCRIPTION OF THE PREFERRED EMBODIMENT

Figure 1:
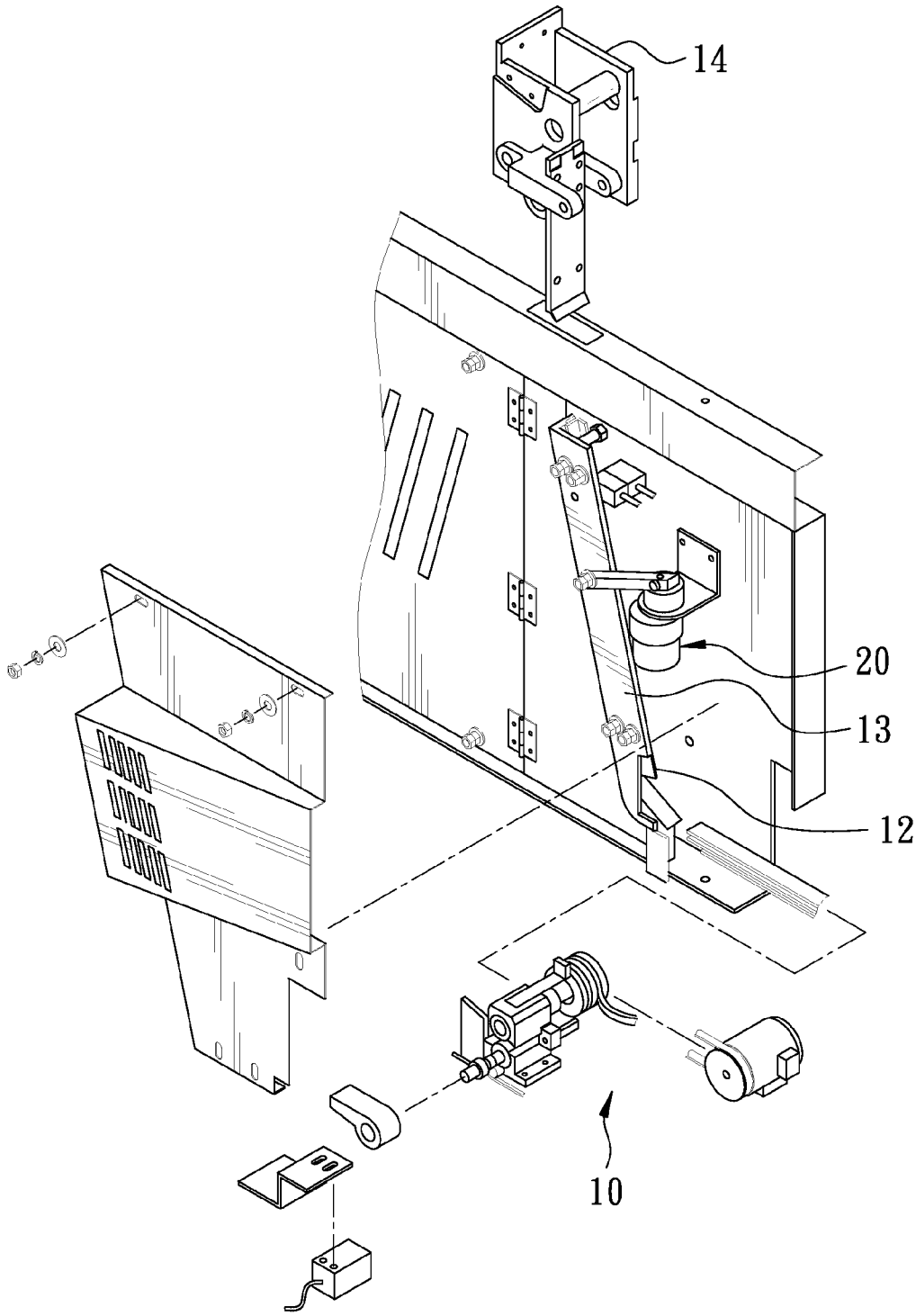
FIG. 1 PRIOR ART
FIG. 1 is an exploded perspective view of a conventional automatic band conveying device of a strapping machine.
Figure 2:
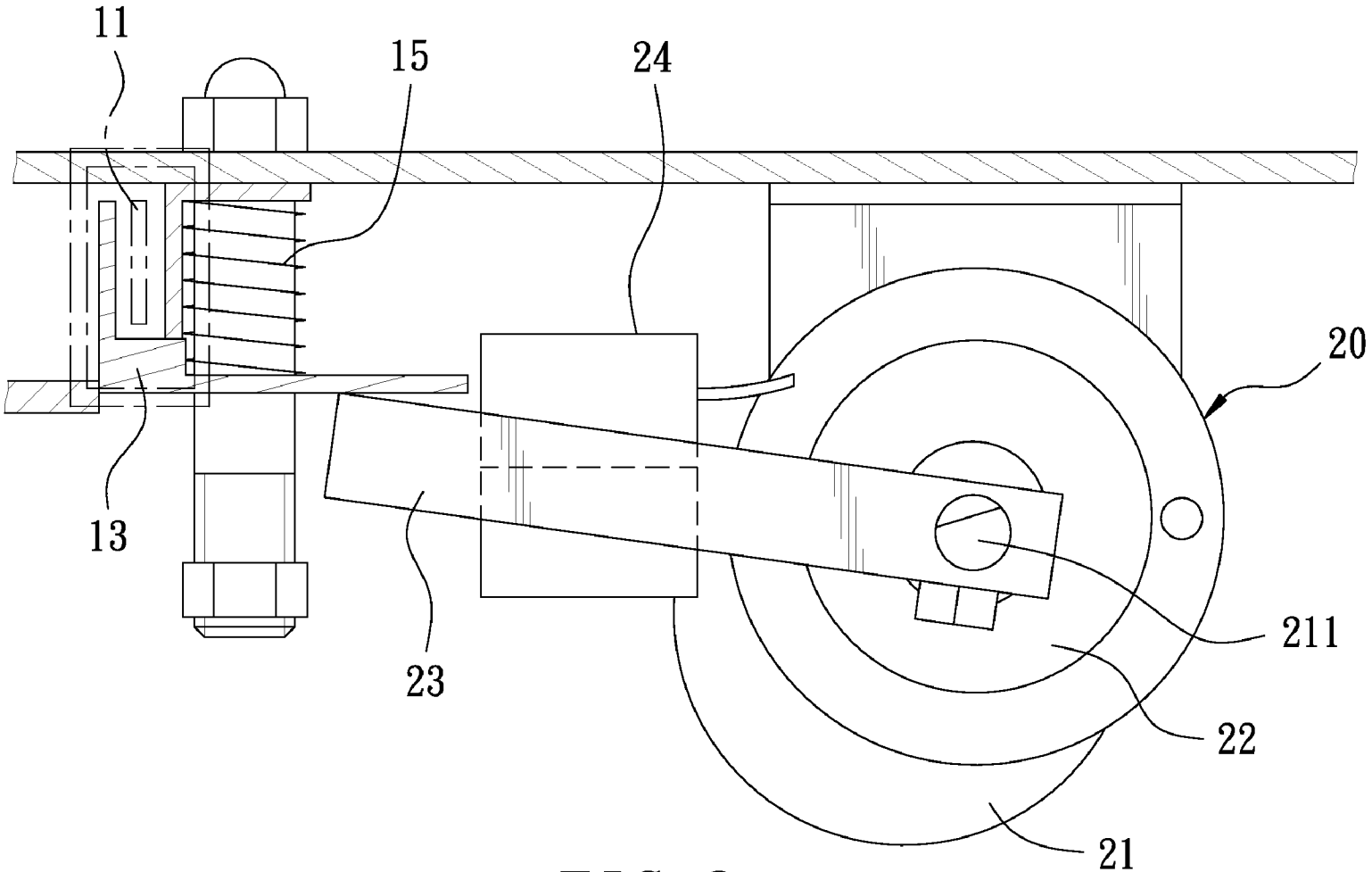
FIG. 2 PRIOR ART
FIG. 2 is a top view of the conventional automatic band conveying device of a strapping machine, showing it being operated.
Figure 3:
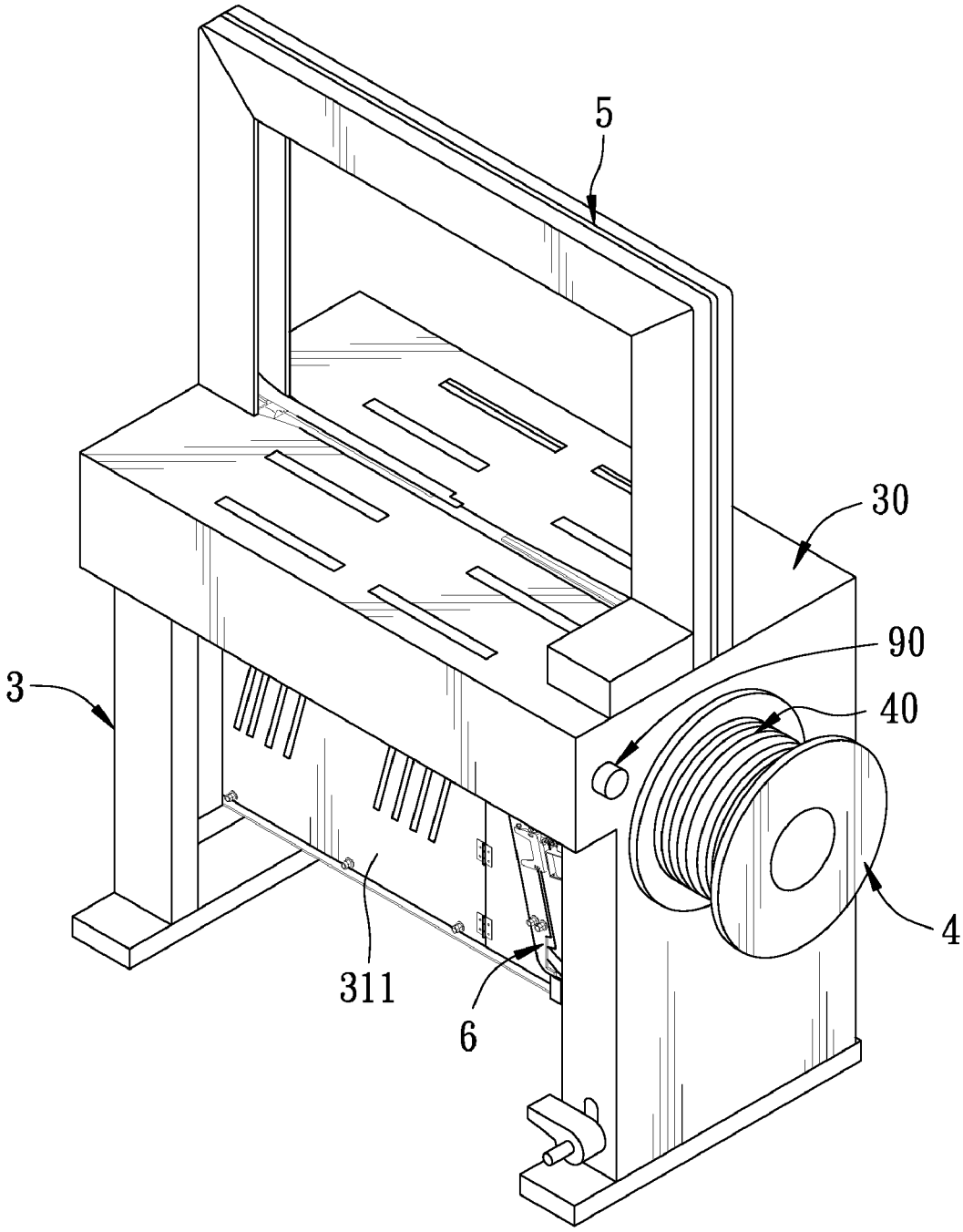
FIG. 3 is a perspective view of a strapping machine installed with an automatic band conveying device in the present invention.
Figure 4:
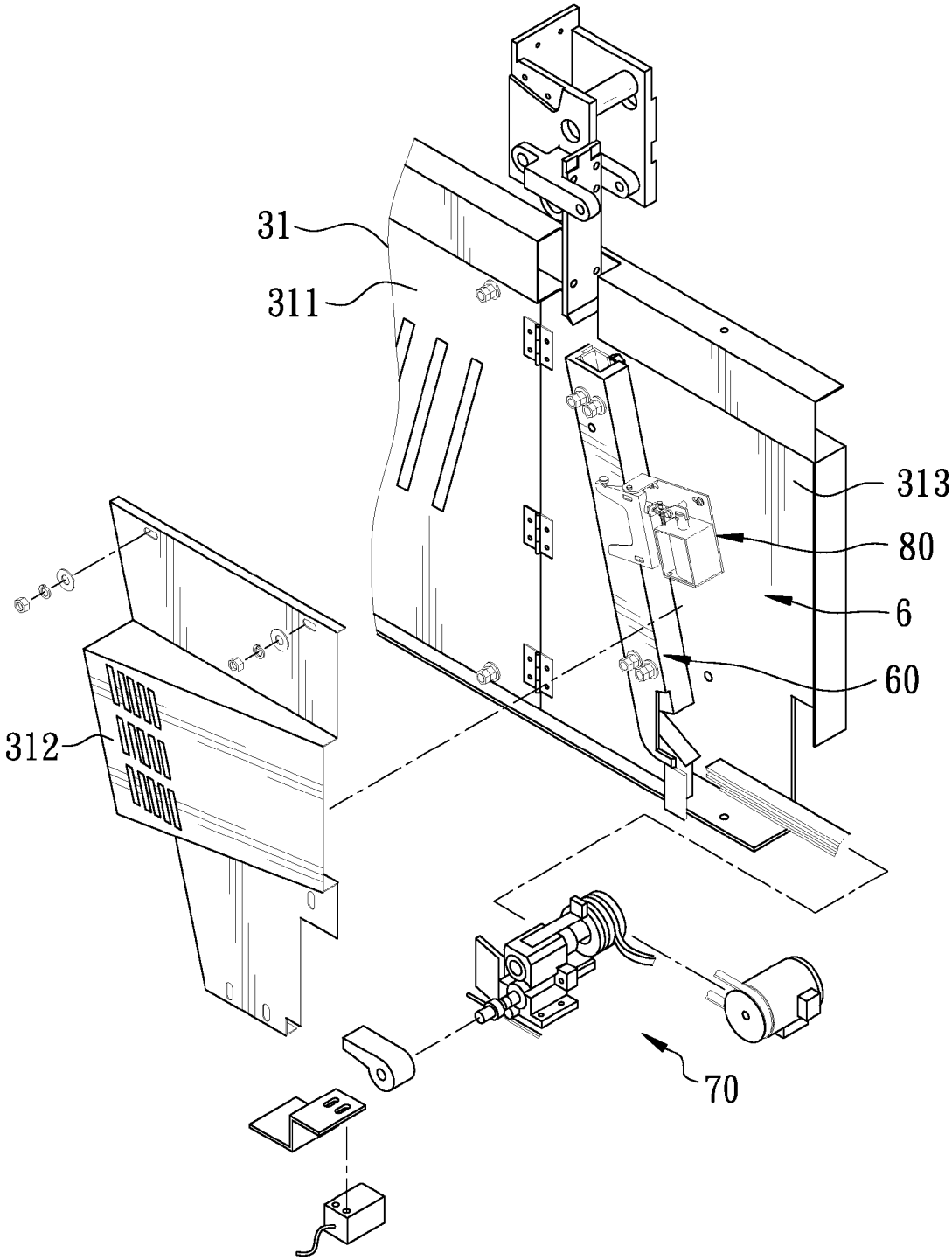
FIG. 4 is a perspective view of a first preferred embodiment of an automatic band conveying device in the present invention.
Figure 5:
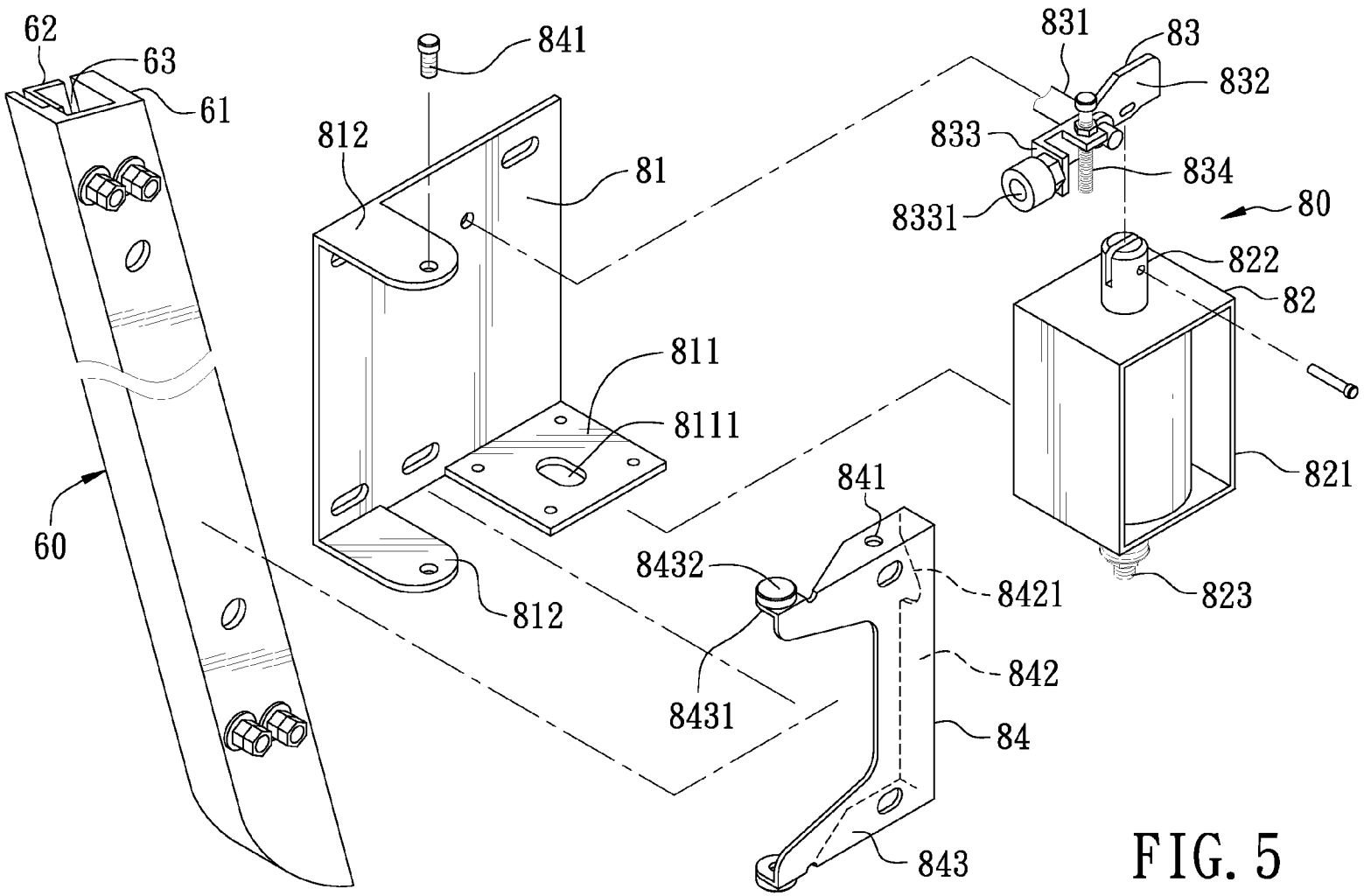
FIG. 5 is an exploded perspective view of a pressing rail device of the first preferred embodiment of an automatic band conveying device in the present invention.
Figure 6:
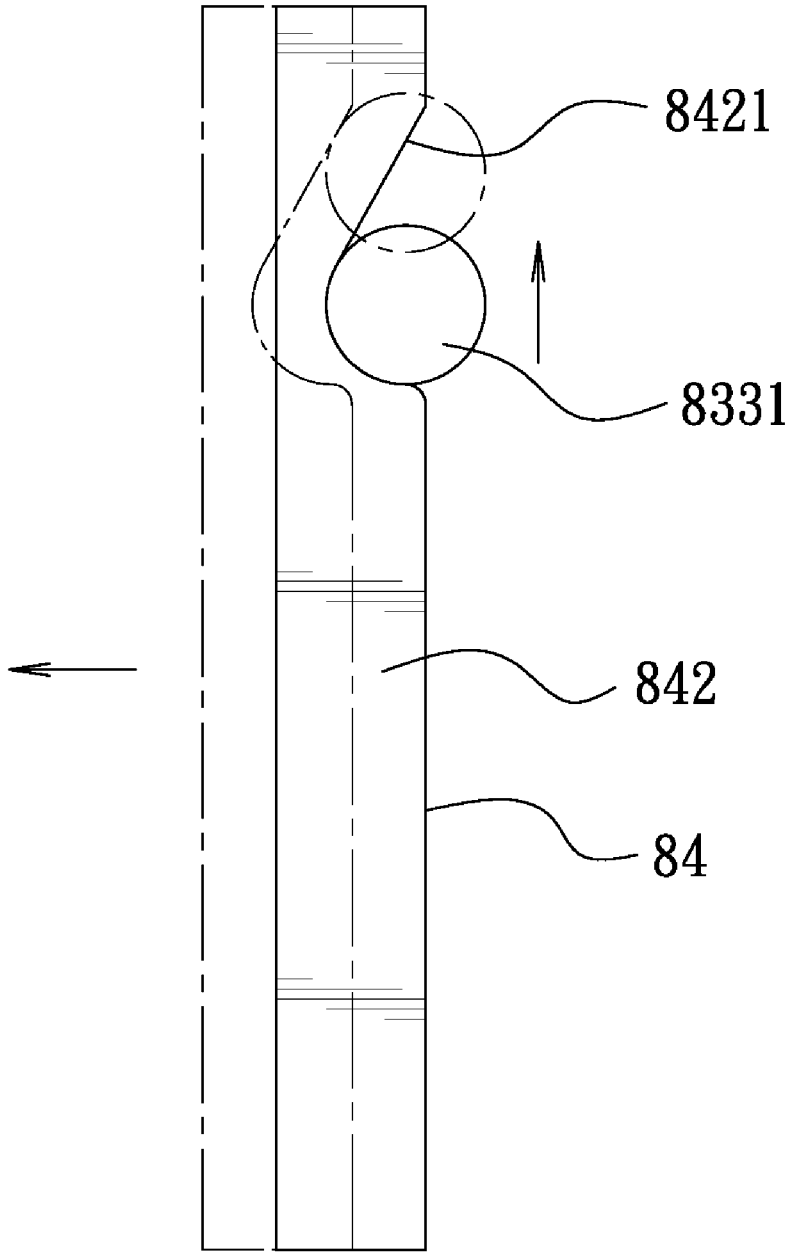
FIG. 6 is a side view of the pressing rail device of the first preferred embodiment of an automatic band conveying device in the present invention.
Figure 7:
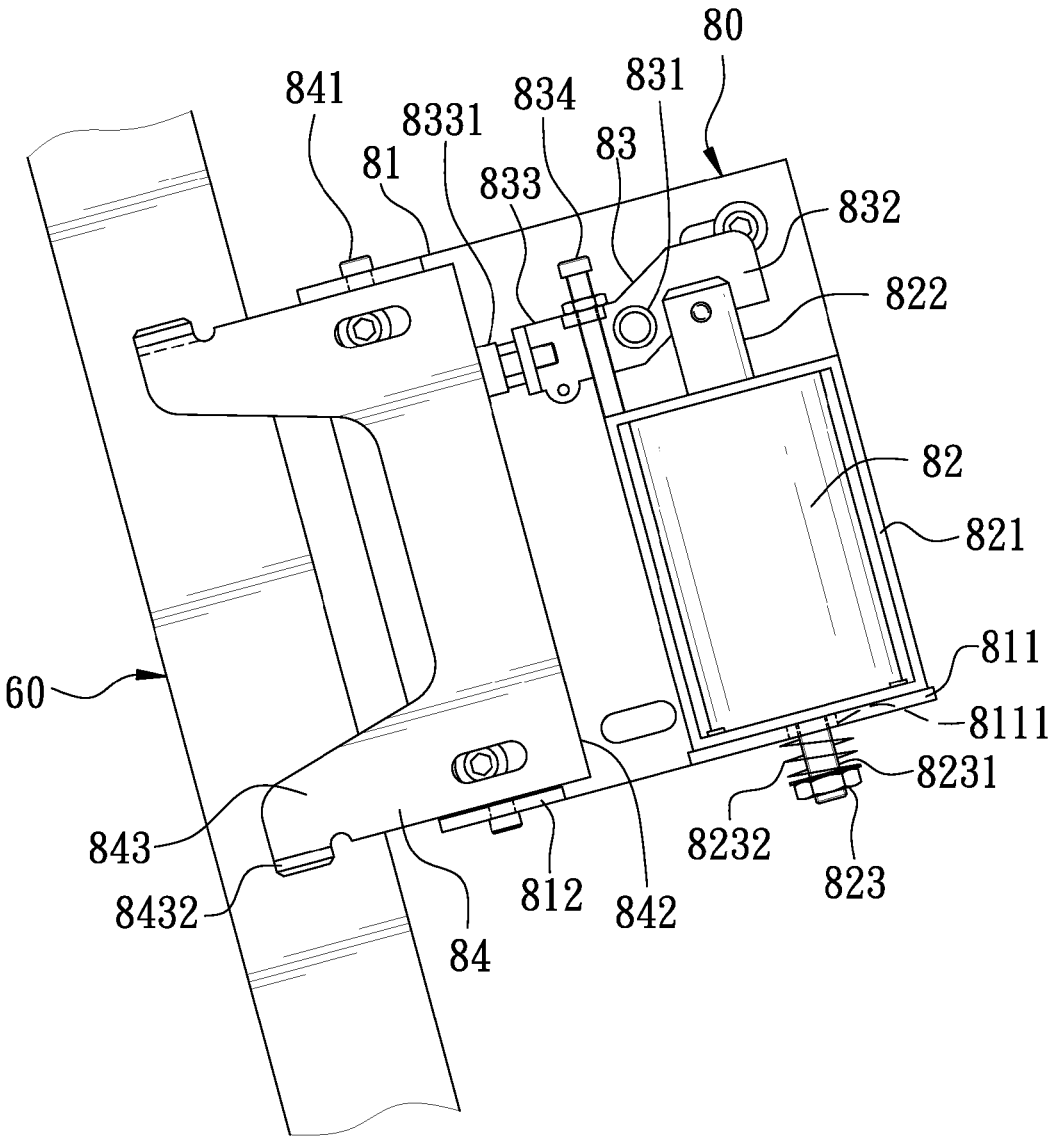
FIG. 7 is another side view of the pressing rail device of the first preferred embodiment of an automatic band conveying device in the present invention.
Figure 8:
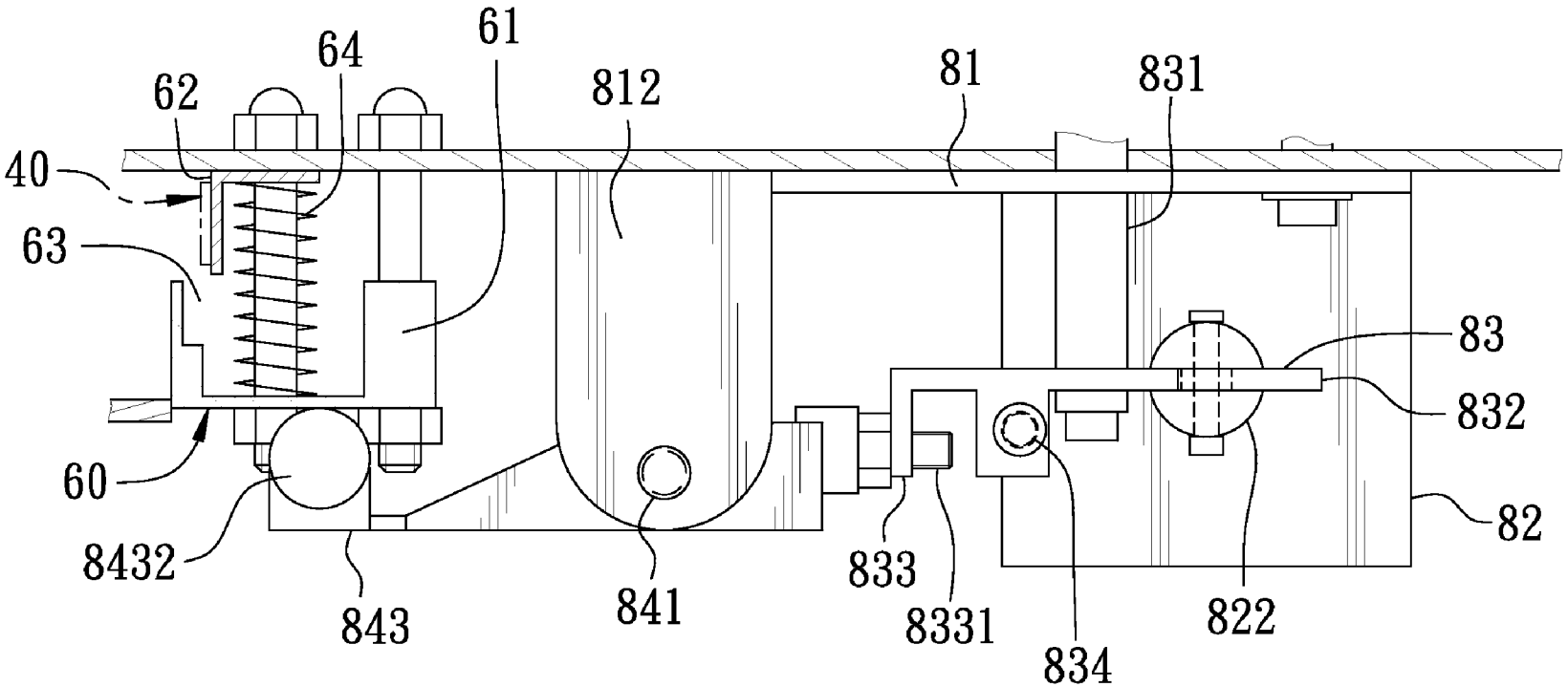
FIG. 8 is a top view of the pressing rail device of the first preferred embodiment of an automatic band conveying device in the present invention.
Figure 9:
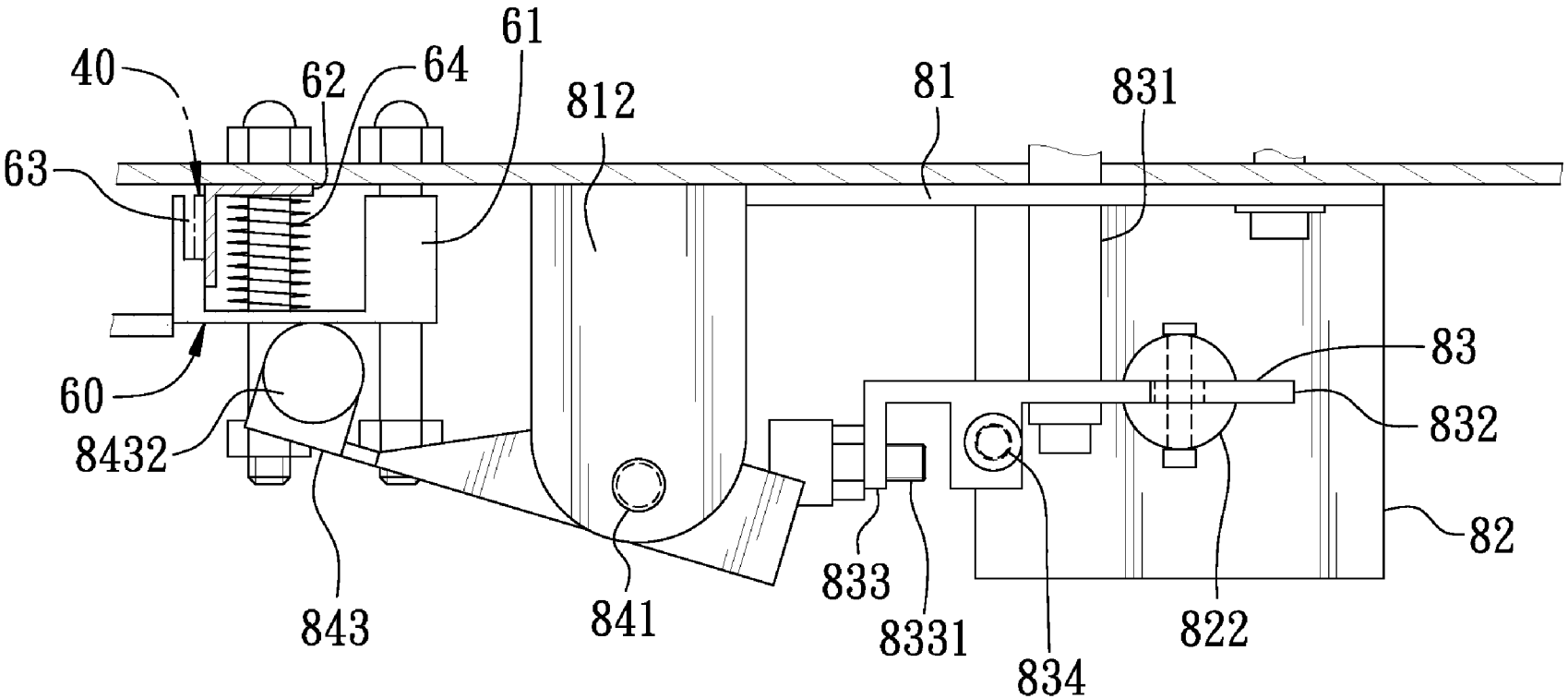
FIG. 9 is a top view of the pressing rail device of the first preferred embodiment of an automatic band conveying device in the present invention, showing it being operated.

FIGS. 3~5 show a first preferred embodiment of an automatic band conveying device 6 in the present invention. The automatic band conveying device 6 is employed in a strapping machine that is composed of a main body 3, a band reel unit 4, a bow-shaped frame 5 and the automatic band conveying device 6.

The main body 3 is provided with a working platform 30 and a band storing box 31 positioned at a preset location inside it. The band storing box 31 is composed of a front board 311, a side board 312 and a rear board 313.

The band reel unit 4 is installed at one side of the main body 3.

The bow-shaped frame 5 is positioned on the top of the main body 3 for a band 40 to be positioned on.

The automatic band conveying device 6 is installed inside the main body 3, provided with a band rail 60, a band transmitting device 70, a pressing rail device 80 and a switch 90. The band rail 60 is installed on the main body 3, provided with a ⊓-shaped separating portion 61 formed on its top, a L-shaped blocking plate 62 fixed on the main body 3, and a band rail groove 63 formed adjustable between the separating portion 61 and the blocking plate 62. In addition, a compression spring 64 is placed between the separating portion 61 and the blocking plate 62, able to be elastically squeezed by the separating portion 61. The band transmitting device 70 is employed to send the band 40 into the band rail 60. The pressing rail device 80 includes a main plate 81, an electromagnetic valve 82, a connecting rod 83 and a pressing plate 84.

The main plate 81 is fixed on the main body 3, provided with a positioning plate 811 vertically extended out from its bottom side opposite to the band rail 60, and two extended ears 812 extended out respectively from its top side and its bottom side close to the band rail 60. The positioning plate 811 is bored with an oval hole 8111.

The electromagnetic valve 82 is provided with a positioning member 821, a movable member 822 and an elastic element 823 pivotally fixed at the bottom of the positioning member 821. The elastic element 823 is provided with a screw 8231 extended out of the positioning member 821 to enter the oval hole 8111, and a compression spring 8232 elastically installed between the positioning member 821 and the screw 8231. The movable member 822 is pivotally fixed on the positioning member 821, able to be drawn down by a magnetic force created while the positioning member 821 is electrically conducted.

The connecting rod 83 is provided with a supporter 831 pivotally combined on the main plate 81, a first end 832 and a second end 833 located at two sides of the supporter 831 respectively. The first end 832 is pivotally connected with the movable member 822 of the electromagnetic valve 82. The second end 833 is to press on one side of the pressing plate 84, provided with a bearing 8331. And, an adjusting threaded bar 834 is formed on the second end 833, having its bottom pivotally fixed on the positioning portion 821 of the electromagnetic valve 82.

The pressing plate 84 is vertical, provided with a supporting member 841 pivotally fixed on the extended ears 812 of the main plate 81, a driving side 842 formed at one side of the supporting member 841, and a pressing side 843 formed at the other side of the supporting member 841. The driving side 842 is provided with a sliding groove 8421 concaved to correspond to the bearing 8331 of the connecting rod 83 for pivotally fitting with it. Formed at one side of the top and the bottom of the pressing side 843 are two free ends that are respectively formed vertically with a bearing base 8431 for supporting a bearing 8432 supposed to press on the center of the top surface of the band rail 60.

The switch 90 is positioned at a corner of one side of the main body 3 for controlling the band transmitting device 70.

In using, as shown in FIGS. 3~9, when the band transmitting device 70 is started, the positioning portion 821 of the electromagnetic valve 82 of the pressing rail device 80 is to be electrified to create a magnetic force to draw down the movable member 822, which is to simultaneously pull down the first end 832 of the connecting rod 83. By the time, with the supporter 831 functioning as an axis for the connecting rod 83 to seesaw, the second end 833 is moved up to keep the bearing 8331 rolling up along the curve of the sliding groove 8421 to push the driving side 842 to move outwards. And, with the supporting member 841 to function as an axis for the driving side 842 and the pressing side 843 of the pressing plate 84 to swing, the bearing 8432 of the pressing side 843 is to be successively moved to press down the separating portion 61 to keep the band rail groove 63 sealed by the separating portion 61 and the blocking plate 62, so that the band 40 can be forced to pass through the band rail groove 63 by the band transmitting device 70. On the contrary, as the magnetic force of the electromagnetic valve 82 is dismissed, the bearing 8331 is to be moved back to its original position by the connecting rod 83. By the time, the compression spring 64 is to elastically push backward the separating portion 61 that is to correspondingly push back the pressing plate 84, enabling the band rail groove 63 re-opened. As for the adjusting bar 834, it is to lean on the positioning portion 821, adjustable to alter the level of the connecting rod 83 for adjusting the tightness of the band rail 60 forced by the pressing plate 84. In addition, the positioning portion 821 of the electromagnetic valve 82 is elastically fixed on the positioning plate 811, enabling the electromagnetic valve 82 micro-moved to minimize operating error.

Figure 10:
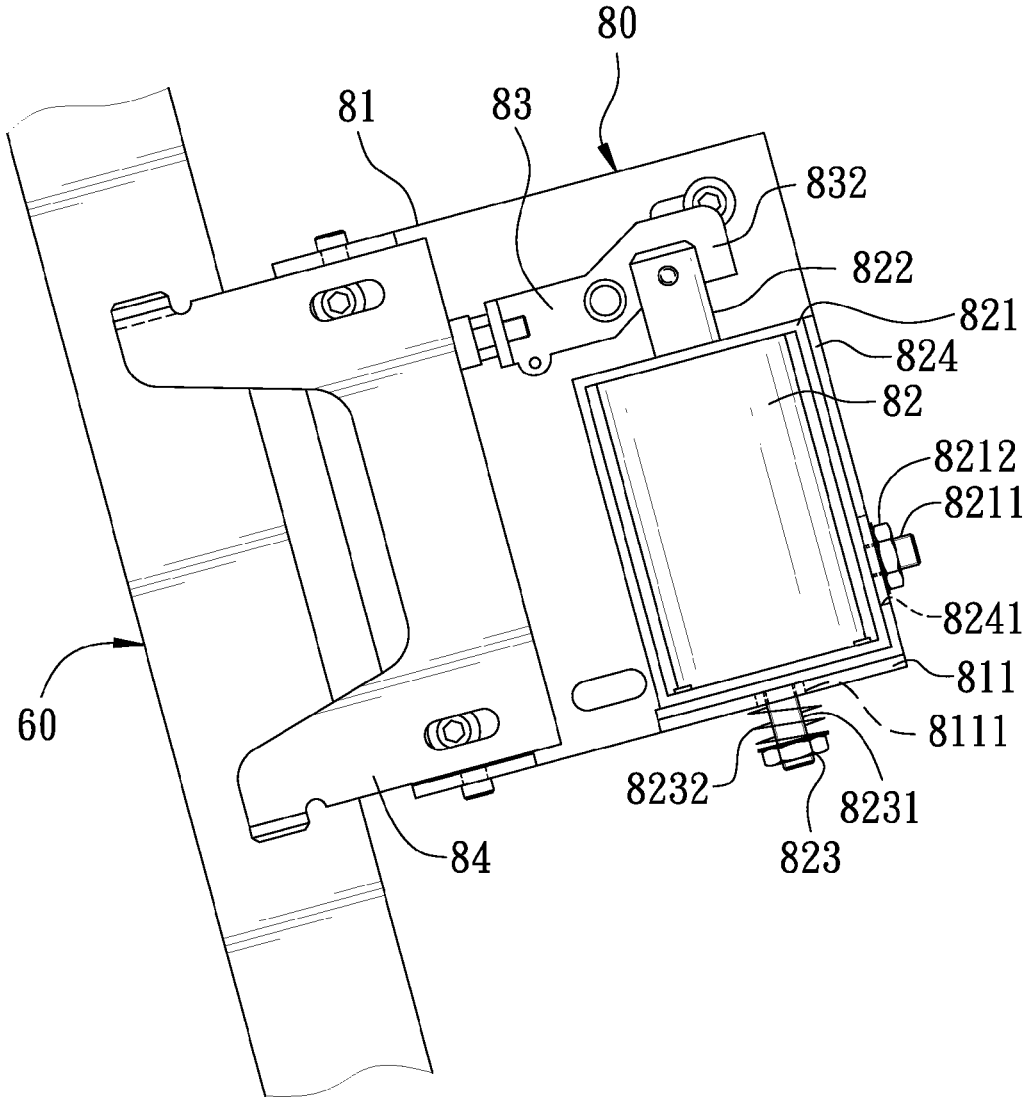
FIG. 10 is a side view of a pressing rail device of a second preferred embodiment of an automatic band conveying device in the present invention.
Figure 11:
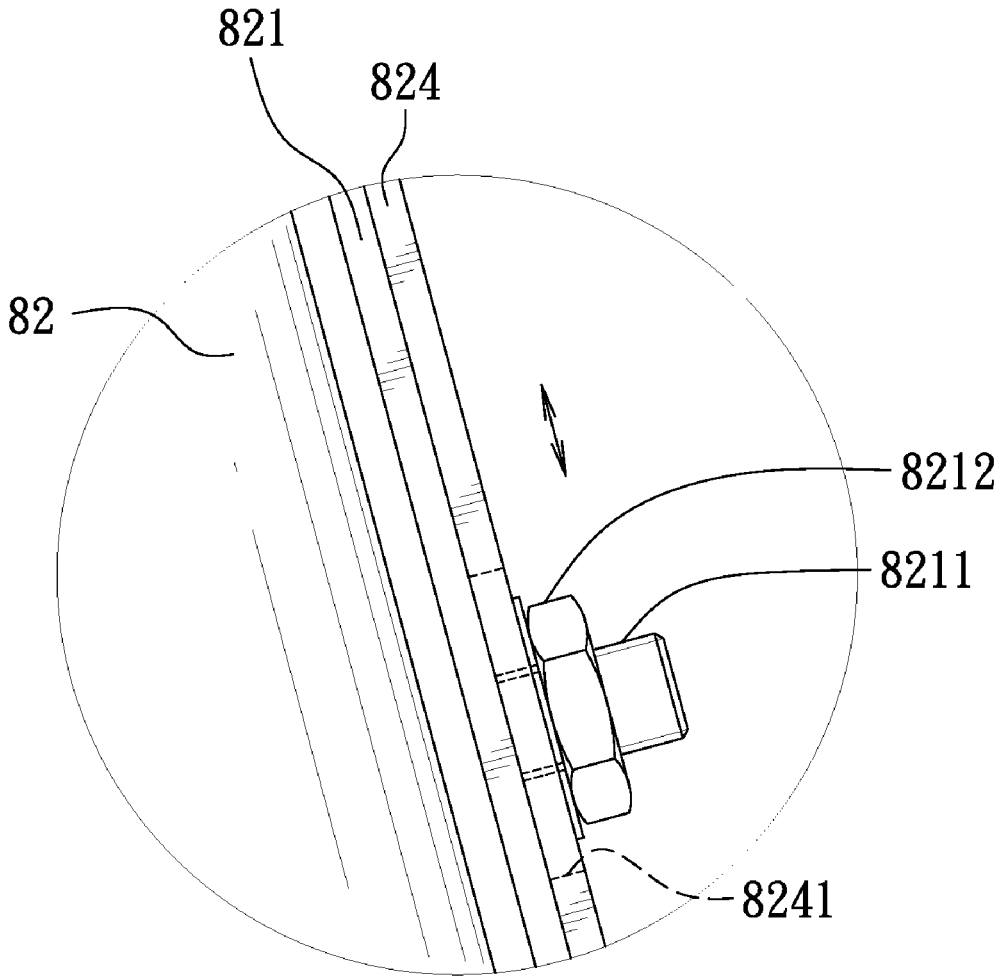
FIG. 11 is a partial magnified side view of the pressing rail device of the second preferred embodiment of an automatic band conveying device in the present invention, showing how it is adjusted.

As shown in FIGS. 10 and 11, a second preferred embodiment of an automatic band conveying device 6 in the present invention has the same components as the first embodiment does, except that the electromagnetic valve 82 is provided with an L-shaped adjusting board 824 connected on the positioning plate 811. The L-shaped adjusting board 824 having its bottom fixed on the elastic element 823 is provided with a long slot 8241 formed in its one side. The positioning portion 821 is provided with a nut 8212 and a screw 8211 extending in the long slot 8241 to be fixed at diverse positions, so as to adjust the tightness of the pressing plate 84 forced by the connecting rod 83.

The advantages of the invention are described below as can be seen from the foresaid description.

With the compression spring 64 set in the band rail 60 to automatically push back the band rail 60, and with the electromagnetic valve 82 turned only on and off to drive the pressing plate 84 to press on the band rail 60, the invention has a simple structure and can be easily operated.

While the preferred embodiment of the invention has been described above, it will be recognized and understood that various modifications may be made therein and the appended claims are intended to cover all such modifications that may fall within the spirit and scope of the invention.

What is claimed is:

1. An automatic band conveying device installed inside a main body of a strapping machine and using a band transmitting device to pass a band through a band rail that is elastically installed on said main body, said band rail comprising a ⊓-shaped separating portion, a L-shaped blocking plate fixed on the main body, a band rail groove formed adjustable between the separating portion and the blocking plate, and a compression spring is placed between the separating portion and the blocking plate, said automatic band conveying device comprising a pressing rail device composed of a main gate, an electromagnetic valve, a connecting rod and a pressing plate:

said main plate is fixed on said main body and said main plate provided with a positioning plate and two extended ears extended out respectively from its top side and its bottom side;

said electromagnetic valve provided with a positioning member that is fixed on said main plate, a movable member pivotally fixed on said positioning member and able to be magnetically attracted to have a displacement by said positioning member;

said connecting rod provided with a supporter that is pivotally fixed on said main plate, a first end of said connecting rod located at one side of said supporter is connected to said movable member of said electromagnetic valve, a second end of said connecting rod is mutually moved together with said pressing plate; and said pressing plate provided with a supporting member that is pivotally fixed on one of the extended ears, a driving side formed at one side of said supporting member for moving together with said second end of said connecting rod, a pressing side formed at another side of said supporting member for leaning the ⊓-shaped separating portion of said band rail, said driving side provided with a sliding groove that is concaved at a preset portion of said driving side for corresponding to said second end of said connecting rod.

2. The automatic band conveying device as claimed in claim 1, wherein said pressing plate is vertical, and said second end of said connecting rod provided with a bearing to roll along said sliding groove.

3. The automatic band conveying device as claimed in claim 1, wherein said pressing side of said pressing plate has a top and a bottom of its one side respectively formed as a free end that is extended out to form a bearing base for supporting a bearing to roll on said band rail.

4. The automatic band conveying device as claimed in claim 1, wherein said connecting rod is provided with an adjusting threaded bar engaged with said second end for being adjusted to move up and down to stay on said positioning member of said electromagnetic valve.

5. The automatic band conveying device as claimed in claim 1, wherein said electromagnetic valve is provided with an elastic element pivotally fixed at a bottom of said positioning member, said elastic element composed of a screw and a compression spring, said screw mounted by said compression spring after being inserted through an oval hole bored in said positioning plate to keep said electromagnetic valve elastically fixed on said positioning plate of said main plate.

6. The automatic band conveying device as claimed in claim 1, wherein said electromagnetic valve is provided with an L-shaped adjusting board having its bottom connected on said positioning plate and fixed with an elastic element that includes a screw and a compression spring, said screw mounted by said compression spring after being inserted through an oval hole bored in said positioning plate to keep said electromagnetic valve elastically fixed on said positioning plate of said main plate, said L-shaped adjusting board provided with a long slot formed in its one side for a screw to be adjustably fixed in it to alter a position of said positioning portion.

* * * * *